US006810629B1

(12) United States Patent
Hughes

(10) Patent No.: US 6,810,629 B1
(45) Date of Patent: Nov. 2, 2004

(54) WINDOW WELL COVER APPARATUS

(75) Inventor: Steve D. Hughes, Dexter, IA (US)

(73) Assignee: Monarch Manufacturing Company, Adel, IA (US)

( * ) Notice: Subject to any disclaimer, the term of this patent is extended or adjusted under 35 U.S.C. 154(b) by 0 days.

(21) Appl. No.: 10/355,630

(22) Filed: Feb. 3, 2003

(51) Int. Cl.[7] ..... E06B 5/02
(52) U.S. Cl. ..... 52/107; 52/19; 52/90.1
(58) Field of Search ..... 52/107, 19, 20, 52/201, 90.1, 202, 73, 74, 76, 77

(56) References Cited

U.S. PATENT DOCUMENTS 4,478,013 A * 10/1984 Tavano ..... 52/92.2
4,756,127 A * 7/1988 Helterbrand et al. ..... 52/93.1
4,903,455 A * 2/1990 Veazey ..... 52/800.11
5,339,579 A * 8/1994 Woodyer et al. ..... 52/107
5,752,348 A * 5/1998 Pearson ..... 52/107
6,003,279 A * 12/1999 Schneider ..... 52/481.1

* cited by examiner

*Primary Examiner*—Carl D. Friedman
*Assistant Examiner*—Naoko Slack
(74) *Attorney, Agent, or Firm*—G. Brian Pingel; Camille L. Urban

(57) ABSTRACT

An apparatus for serving as a cover for a window well associated with a window of a building and including a frame member having two vertically spaced apart inwardly extending projections, a retainer assembly that serves as a connection between the frame member and the building and also has a pair of vertically spaced apart outwardly extending projections, at least one support beam extending between and supported by the lower most projections, and a protective cover member overlying the support means and having edge portions received within the spaces between the projections of the frame member and the retainer assembly.

12 Claims, 8 Drawing Sheets

WINDOW WELL COVER APPARATUS

BACKGROUND OF THE INVENTION

1. Field of the Invention

The present invention relates in general to a cover for a window well associated with a window of a building and more specifically concerns a window well cover that can be semi-permanently attached to the side of the building so that the window well can be opened for access as desired.

2. Description of the Prior Art

The use of window wells surrounding the exterior of below grade windows, such as a window in the basement wall of a building is widely known. Normally, such windows are near the upper side of the basement wall but are either partly or wholly below grade. To protect the window from backfill and other damage and to allow sunlight to be exposed to the window, it is customary for a window well to be placed around the full exterior of the window.

To comply with safety regulations concerning ingress and egress from below grade windows and to increase the amount of sunlight that is allowed therethrough, a trend has developed of providing relatively large window wells surrounding such windows. Although such enlarged construction has many advantages, it is also has the disadvantages of allowing for rubbish and other materials to collect in the window well areas and in times of intense rain can serve as a collecting basin for unwanted amounts of moisture.

To lessen the above noted disadvantages, it is known in the art to provide window well covers for below grade windows and a variety of different types of embodiments of such covers have previously been utilized. For example, U.S. Pat. No. 4,903,455 issued to Veazey discloses a window well cover that includes an extruded metal frame for receiving the perimeter portions of a plastic glazing sheet to serve as a cover member for a window well. Although such window well structure appears to provide a relatively lightweight cover apparatus for a window well, the specific structure it employs appears to be unnecessarily complicated and relatively expensive to manufacture. The present invention provides an improved structure for a window well cover apparatus that avoids the foregoing disadvantages.

SUMMARY OF THE INVENTION

The present invention provides an apparatus for serving as a cover for a window well associated with a below grade window of a building and comprises a frame member conforming to the shape of the window well and has spaced apart inwardly extending projections, a retainer means that serves as a connection between said frame member and said building and has a pair of outwardly extending projections, beam means extending between the lower most projection of said frame member and the lower most projections of said retainer member, and a protective cover member overlying said beam means.

The protective cover member is designed to have edge portions receivable within the spaces between the frame member projections and the retainer means projections to secure said cover in a fixed position in said apparatus to close off the top of the window well. Furthermore, the frame member includes means for seating said member on the upper periphery of the window well.

Preferably, the retainer means provides a semi-permanent connection between said frame member and said building and also provides a pivotable connection therebetween so that the frame member can be pivoted with respect to the building to open the window well to the outside to readily enable ingress and egress if it is desired for safety reasons or other purposes.

Other objects, features and advantages of the present invention will be readily appreciated from the following description. Such description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF THE PREFERRED EMBODIMENT

Figure 1:
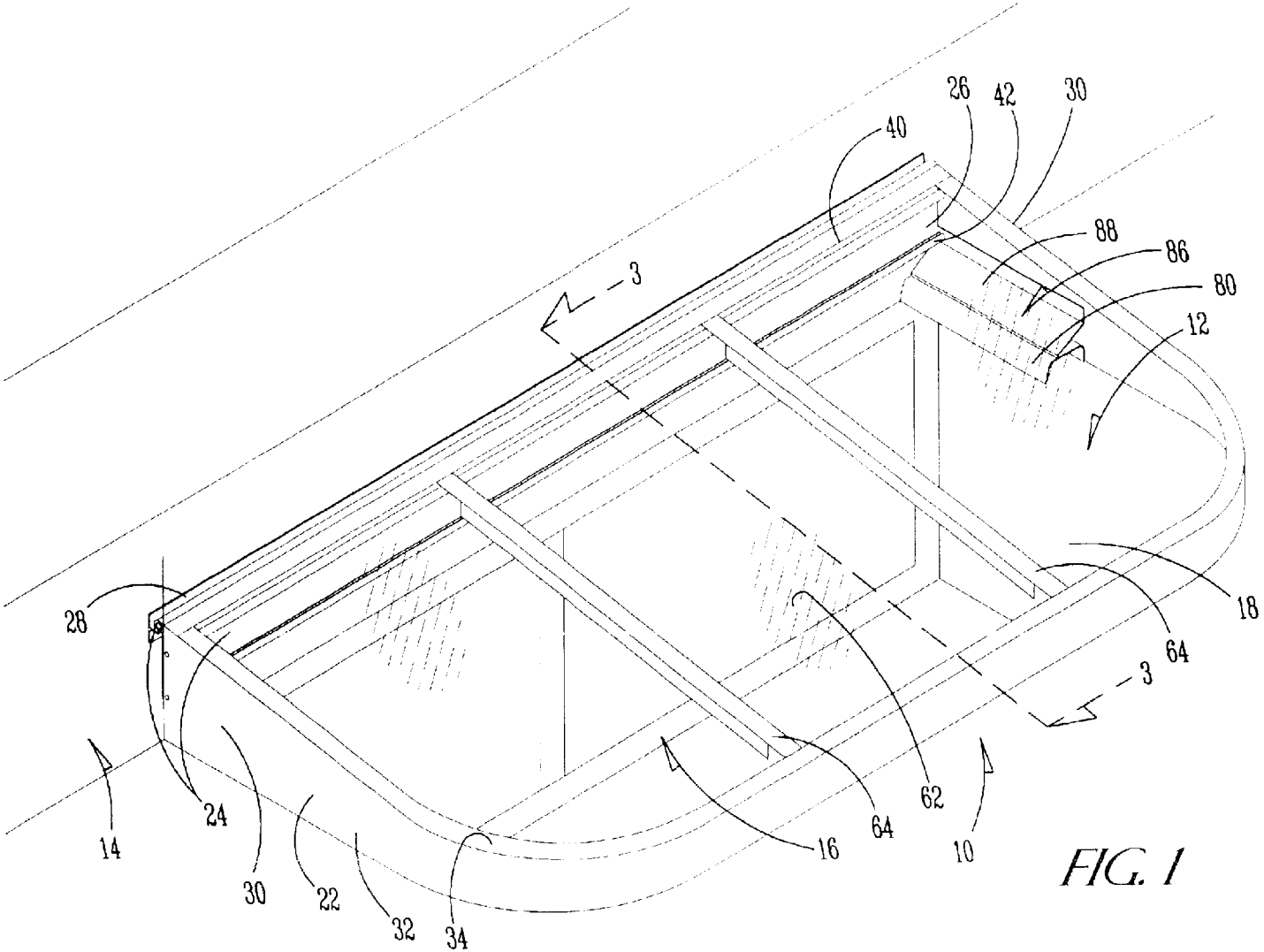
FIG. 1 is a perspective view of a preferred embodiment of a window well cover apparatus in accordance with the present invention associated with the side of a building and a window well.

Referring now to the drawings and with reference first to FIG. 1, a preferred embodiment of a window well cover apparatus of the present invention is shown at 10 and is designed to be utilized in association with a window well 12 and is preferably, semi-permanently affixed to the side of a building 14. The window well 12, as is commonly known, extends outwardly from the side of the building 14 to form a perimeter around a below grade window 16 that provides an open area 18 in front of the window 16 that not only provides exposure of the window 16 from above ground, but also permits ingress and egress through the opening of the window 16 in the event of the need for an emergency exit from the building 14.

Figure 2:
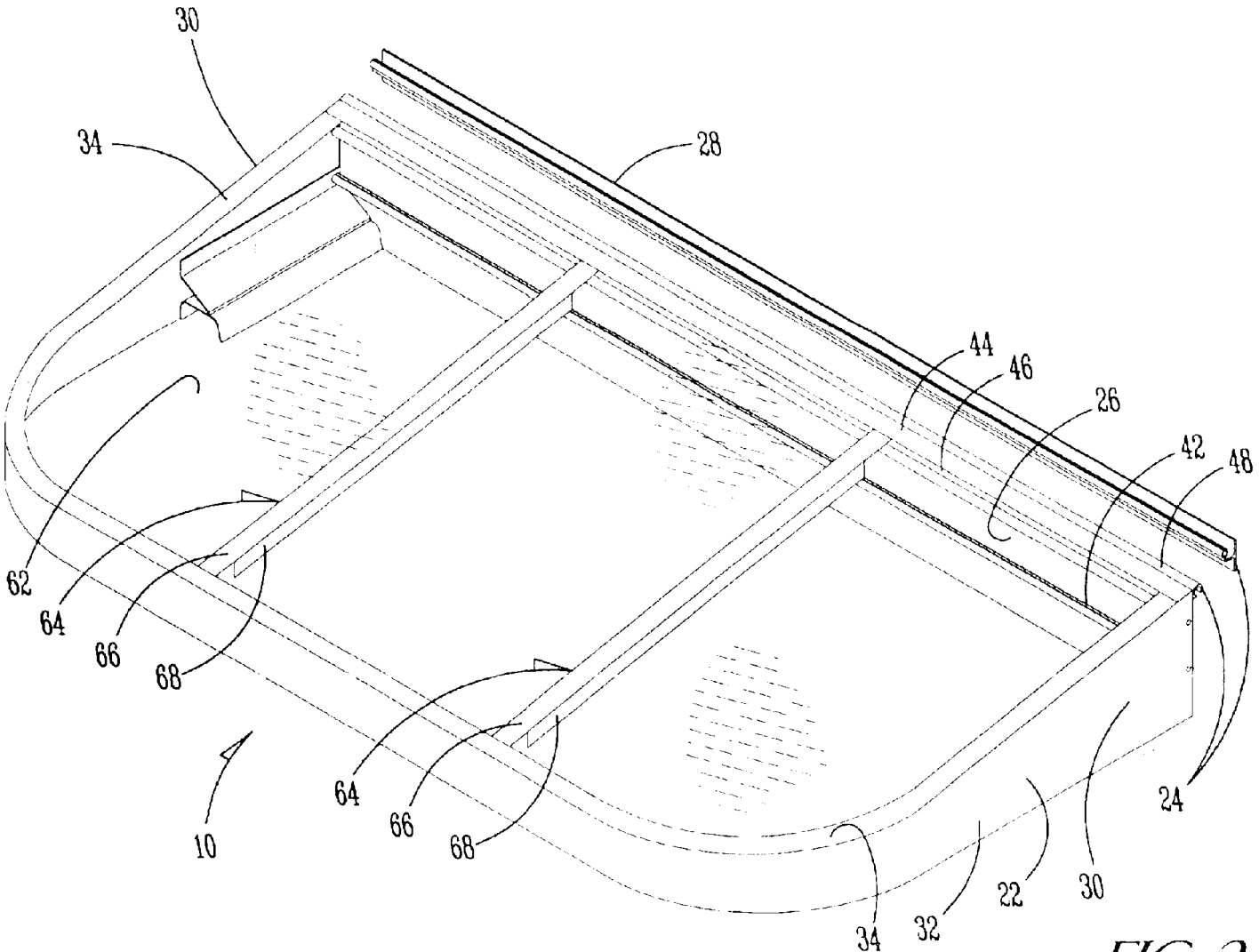
FIG. 2 is a perspective view of the embodiment of FIG. 1, but showing the window well cover apparatus by itself and in a partially exploded format.

The periphery of the cover apparatus 10 as shown in FIGS. 1 and 2 is preferably formed by a somewhat arcuately shaped frame member 22, a retainer means 24 that is formed from a back plate 26 and a support plate 28 to preferably provide a semi-permanent and pivotable connection of the cover apparatus 10 to the building 14. The frame member 22 is preferably formed from extruded aluminum and is shaped to conform to the configuration of the window well 12, whatever it may be.

As indicated best by FIGS. 1 and 2 the frame member 22 has a relatively large cross-section at its inner ends 30 and tapers downwardly toward the outer perimeter of the cover apparatus 10 to provide it with a downwardly slanting top surface to direct moisture from the side of the building 14.

Figure 3:
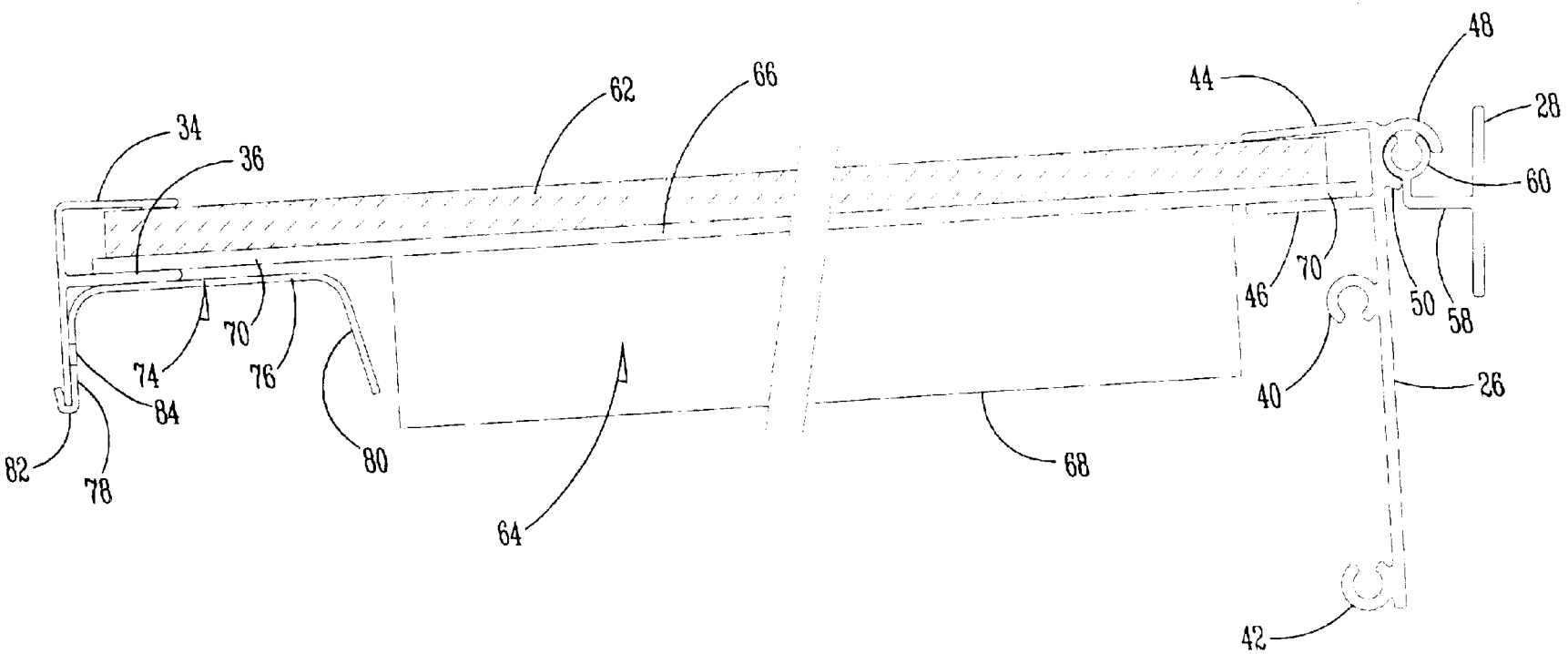
FIG. 3 is a cross-sectional view of the embodiment of FIG. 1 taken along the line 3—3 of FIG. 1.
Figure 4:
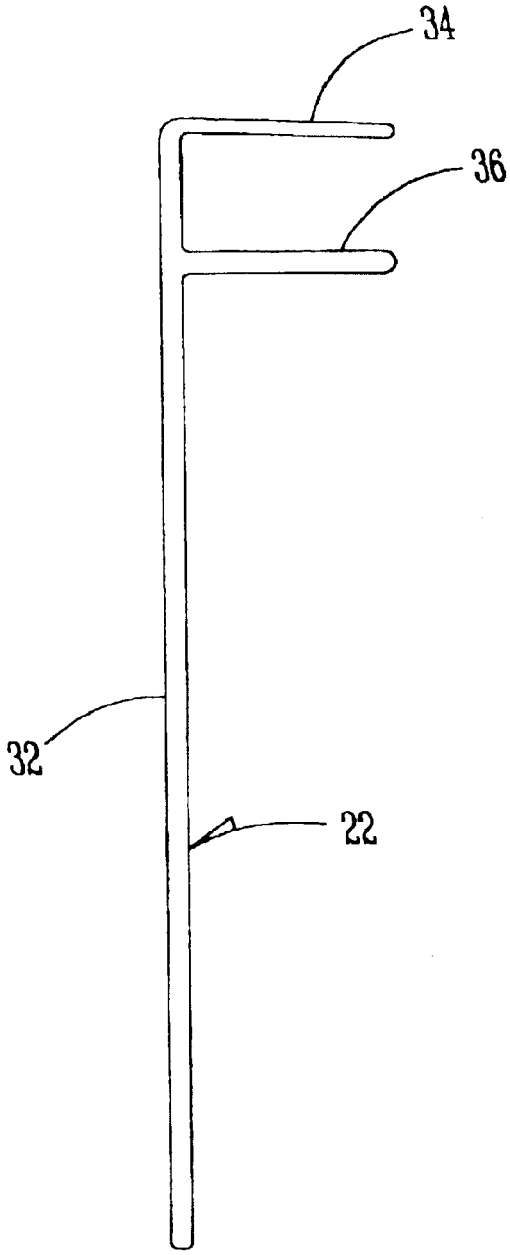
FIG. 4 is a cross-sectional view taken across one of the inner ends of a frame member forming a portion of the embodiment of FIG. 1.
Figure 5:
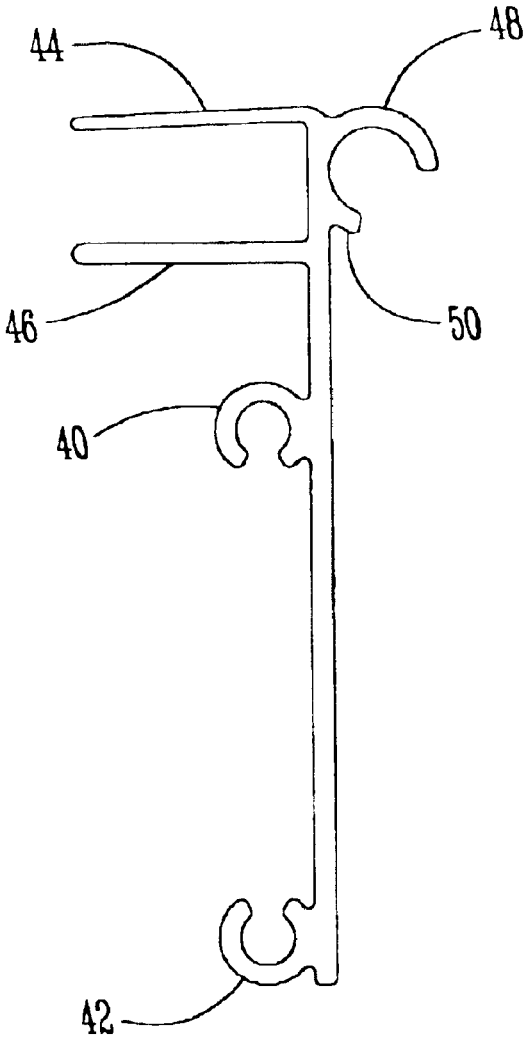
FIG. 5 is an end view a back plate that serves as a portion of a retainer means for pivotally attaching the embodiment of FIG. 1 to the building.

As indicated by FIG. 4, the frame member 22 is formed with a thin body portion 32 and two vertically spaced apart inwardly extending projections 34 and 36, with the projection 34 serving as the top of the frame member 22. As further indicated in FIGS. 1 and 3, the back plate 26 of the retainer means 24 extends between the opposite inner ends 30 of the frame member 22 to serve as a connecting member therebetween.

The back plate 26 has an upper screw boss 40 and a lower screw boss 42 at each end preferably for receiving screws (screws are well known in the art and are not shown) for attaching the frame member 22 to the back plate 26. Additionally, in a somewhat similar fashion to the frame member 22, the back plate 26 has outwardly extending projections 44 and 46 that are vertically spaced apart, with the upper projection 44 serving as the top of the plate 26. Extending outwardly from the opposite side of the plate 26 are a relatively long arcuately shaped finger 48 and a lower, shortened finger 50 that serve as one-half of a pivotal connection between the back plate 26 and the support plate 28.

Figure 6:
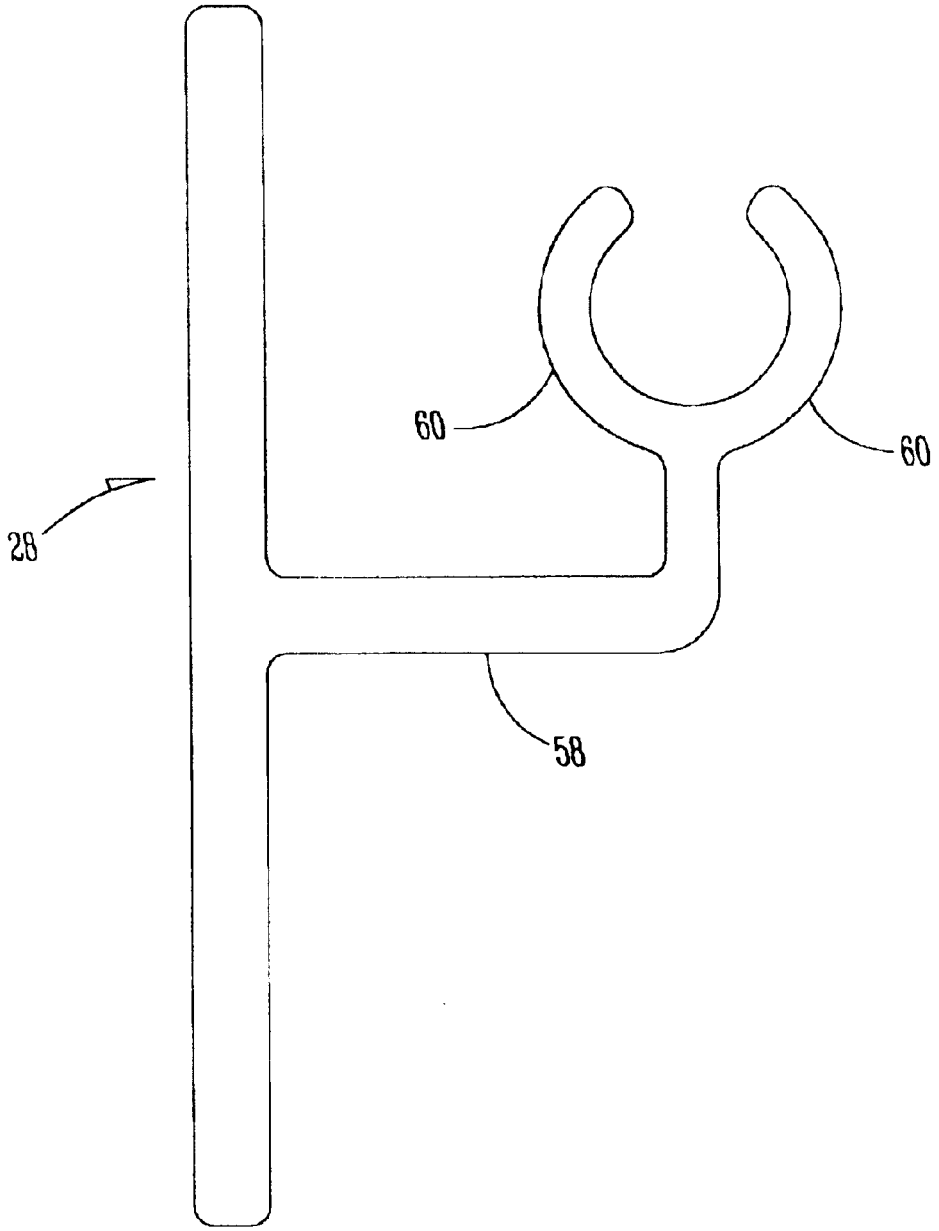
FIG. 6 is an end view of a support plate that coacts with the back plate of FIG. 5 to form the retainer means for the embodiment of FIG. 1.

Referring now to FIG. 6, the support plate 28 has an elongated flat body portion 52 that is attachable to the side of the building 14 by screws or the like. Extending outwardly from the body portion 52 is an arm 58 that terminates in arcuately shaped ends 60 that form a "C" shape sized to be received within the space between the fingers 48 and 50 of the back plate 26, all as shown best in FIG. 3 to provide a semi-permanent attachment of the back plate 26 to the support plate 28 in a pivotable relationship.

Figure 8:
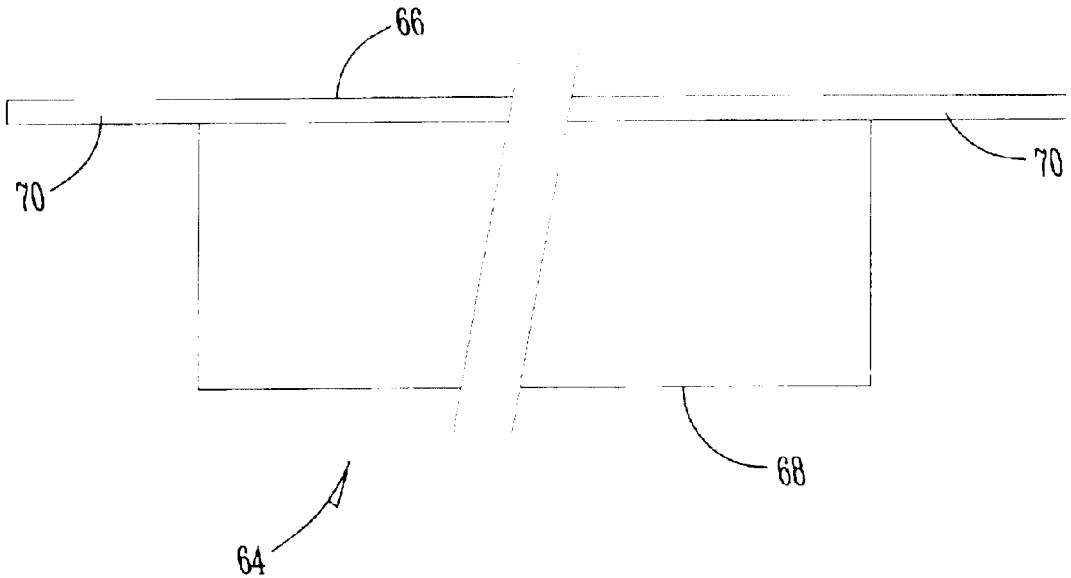
FIG. 8 is a side view of the beam member of FIG. 7.
Figure 7:
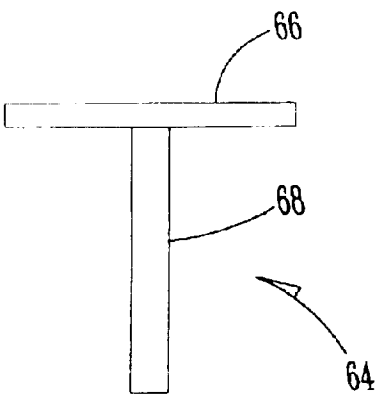
FIG. 7 is an end view of a beam member included in the embodiment of FIG. 1.

The projections 34 and 36 on the frame member 22 and the projections 44 and 46 on the back plate 26 are vertically spaced apart equal distantly for receiving a stiff sheet of protective transparent plastic material 62 that acts as a top for the cover apparatus 10. Also, the lower projections 36 and 44 serve as supports for preferably two beams 64 that extend between the back plate 26 and the frame member 22 and are overlaid by and maintain the sheet 62 in position. As shown in FIGS. 7 and 8, the central portion of the support beams 64 are each formed in somewhat of a "T" configuration with a horizontally aligned top section 66 and a leg section 68 that is orthogonal to the top section 66. However, as shown in FIG. 8, the leg section 68 of each beam 64 does not extend the full length of the top section 66 so that the ends 70 of the top section 66 are flat to permit them to extend into the spaces between the projections 34 and 36 and 44 and 46 to be supported thereby and in turn support the plastic sheet 62.

Figure 9:
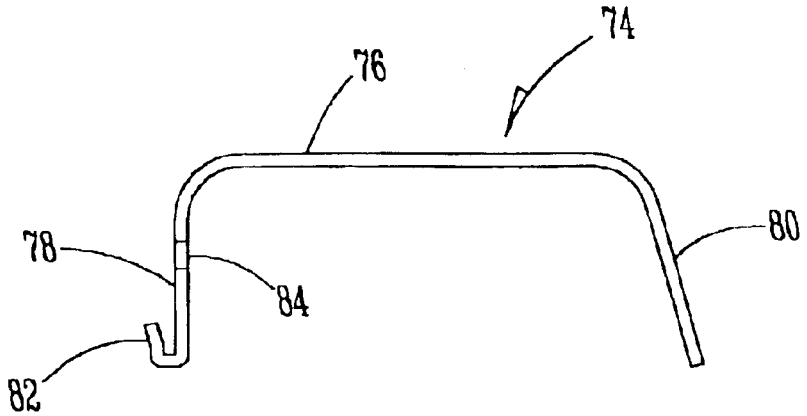
FIG. 9 is a front saddle member included in the embodiment of FIG. 1.

In view of the fact that the side wall of the frame member 22 is relatively thin it is highly advantageous to provide the frame member 22 with some type of seating means that will readily accept and engage the top of the window well 12 in a satisfactory manner so as to provide a proper alignment therebetween. Referring now to FIG. 9, a generally U-shaped saddle member 74 is shown that serves as an appropriate type of seating means for the front portion of the cover apparatus 10 as indicated in FIG. 3.

The saddle member 74 has a straight midsection 76 and downwardly extended legs 78 and 80 to form a pocket for receipt of the top of the window well 12. The particular length of the member 74 is not critical but preferably is 6–12 inches long to provide substantial surface contact with the window well 12. To secure the saddle member 74 to the frame member 22, the leg 78 has an upwardly bent end 82 that fits around the bottom edge of the frame member 22 and the leg 78 can be affixed to the frame member either by bolts, welds or screws at 84.

Figure 10:
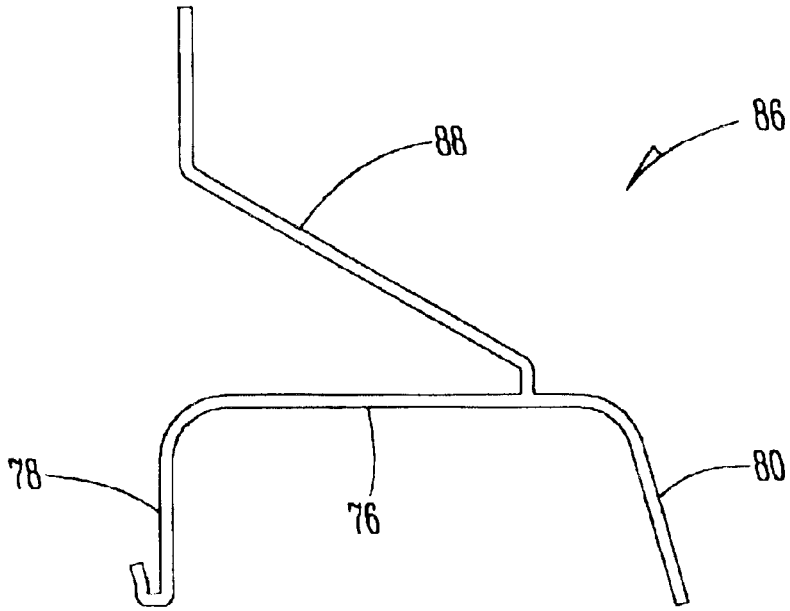
FIG. 10 is a side saddle member included in the embodiment of FIG. 1.

Turning now to FIG. 10, a second type of saddle member 86 is shown for use near the inner ends 38 of the member 22 where it is at its widest. The saddle member 86 is substantially similar in configuration to the member 74 with a midsection 76, legs 78 and 80 and a bent end 82. However, the saddle member 86 further includes an upper brace portion 88 that can be fastened to the frame member 22 to increase the securement between the saddle member 86 and the frame member 22.

Thus, the present invention provides a durable and efficient cover for a variety of shapes of window wells and yet has a structure that is relatively simplistic and inexpensive to manufacture. The foregoing description of the present invention is solely for illustrative purposes only. It is to be understood that the terminology that has been used is intended to be in the nature of words of description rather than of limitation. Many modifications and variations of the present invention are possible in light of the above teachings. For example, there are many different alternatives for providing a seating means for the cover to coact with a window well as well as other types of pivotal connections between the bracket members of the cover. Also, instead of semi-permanently connecting the cover apparatus to a building, it could be permanently fastened thereto and instead of using two support beams 64 one or more beams can be utilized depending upon the amount of support desired for the plastic sheet 62. Therefore the foregoing description is not to be taken as definitive of the scope of the invention, but rather that which is regarded as the invention is set forth in the following claims.

What is claimed is:

1. An apparatus for serving as a cover for a window well associated with a window of a building, said apparatus comprising:

(a) a frame member of a configuration that conforms to the shape of the upper periphery of said window well and has two vertically spaced apart inwardly extending projections located proximate the top of said member;

(b) a retainer means that serves as a connection between said frame member and said building and has a pair of vertically spaced apart outwardly extending projections;

(c) beam means extending between and supported by the lowermost projection of said frame member and the lowermost projection of said retainer member; and (d) a protective cover member overlying said support beam means and having edge portions that are received within the space between said frame member projections and said retainer means projections to secure said cover in a fixed position in said apparatus to close off the top of said window well.

2. A cover apparatus as recited in claim 1, wherein said frame member further includes means for seating said frame member on the upper periphery of said window well.

3. A cover apparatus as recited in claim 1, wherein said retainer means is formed of a support plate that is attached to said building, a back plate that is attached to said frame member and means for connecting said plates together so as to permit said frame member to be pivotally movable to open the top of said window well.

4. A cover apparatus as recited in claim 3, wherein said pivotally connecting means semi-permanently connects said support plate and said back plate together.

5. A cover apparatus as recited in claim 3, wherein said apparatus has at least two beam means spaced apart from one another.

6. A cover apparatus as recited in claim 1, wherein said support means has a central portion that is "T" shaped in cross section and has end portions that are flat so as to lie upon said lowermost frame member projection and said lowermost retainer means projection.

7. A cover apparatus as recited in claim 6, wherein said frame member has inner portions proximate to said building and an outer portion spaced apart from said building and said inner portions each have a vertical cross section larger than the vertical cross section of said outer portion.

8. A cover apparatus as recited in claim 1, wherein said frame member is shaped so that said cover has a downward inclination extending outwardly from said building.

9. A cover apparatus as recited in claim 1, wherein said frame member seating means has a downwardly facing opening for receiving the upper periphery of said window well.

10. A cover apparatus as recited in claim 1, wherein said frame member is arcuately shaped.

11. A cover apparatus as recited in claim 1, wherein said cover is transparent.

12. A cover apparatus as recited in claim 1, wherein said apparatus further includes a window well and means for seating said frame member on the upper periphery of said window well.

* * * * *